United States Patent [19]

Foshee

[11] 4,389,061

[45] Jun. 21, 1983

[54] MORTISE LOCK WITH IMPROVED DEADLOCK RELEASE MECHANISM

[75] Inventor: William R. Foshee, Indianapolis, Ind.

[73] Assignee: Best Lock Corporation, Indianapolis, Ind.

[21] Appl. No.: 224,380

[22] Filed: Jan. 12, 1981

[51] Int. Cl.[3] ..... E05C 1/16

[52] U.S. Cl. ..... 292/169.14; 292/DIG. 26

[58] Field of Search ..... 70/107, 150; 292/34, 292/169.14, 191, DIG. 26

[56] References Cited

U.S. PATENT DOCUMENTS

| | | | |
|---|---|---|---|
| 2,435,238 | 2/1948 | Schlage | 292/DIG. 26 |
| 3,375,687 | 4/1968 | Foster | 70/150 |
| 3,672,714 | 6/1972 | Schultz | 292/34 |
| 3,999,411 | 12/1976 | Kambic | 292/34 X |
| 4,118,056 | 10/1978 | Alexander | 292/169.17 |

*Primary Examiner*—Richard E. Moore

*Attorney, Agent, or Firm*—Barnes & Thornburg

[57] ABSTRACT

A hotel-function mortise lock with improved deadlocking and deadlocking release cam mechanism, comprising a release cam block slidably mounted on the latch bolt tailpiece against the rear tailplate by which it is retracted. A latch deadlocking lever pivotally mounted in the lock case has a forward blocker arm movable into deadlocking position behind the latch and has a rearward release arm which carries a cam nose in the path of initial movement of a cam finger on the slidable cam block, so that latch-retracting movement of the cam block initially moves the deadlocking lever to non-blocking position. The lock includes both a key cylinder-actuated lever and a knob hub-actuated lever, both of which are engaged with the cam block so as to act therethrough in retracting the latch and thereby cause the same single cam finger to release the deadlocking lever to permit full retraction of the latch by either of such latch-retracting levers. The lock shown has certain parts usable for other functions, and for hotel function has a stop bar fixed in the case to lock the outer knob hub against rotation.

15 Claims, 7 Drawing Figures

MORTISE LOCK WITH IMPROVED DEADLOCK RELEASE MECHANISM

This invention relates to a mortise lock, and particularly to an improved deadlocking release mechanism for the latch of a mortise lock which has or is adapted to have a hotel function or like function in which the outer knob is fixed against rotation.

It is the general object of the invention to provide a mortise lock mechanism having improved latch-release mechanism for the deadlocking latch bolt, which is of simplified construction and provides smooth and reliable operation and a long operating life, and in which the same single cam releases the latch deadlock when the latch is retracted either by key or knob operation. Mortise locks of the type to which the invention relates generally comprise a case including a front, a latch mounted in the case for movement through the front between retracted and projected positions and biased to projected position, a tailpiece connected to the latch and having a rearward-spaced tailplate for retracting the latch, a deadlocking lever for deadlocking the latch, and an auxiliary latch or other means for positioning the deadlocking lever in deadlocking relation with the latch when the lock is in door-closed position against a strike.

In accordance with the present invention, the mortise lock includes a cam block mounted in the case, preferably slidably mounted on the tailpiece of the latch, for movement against said tailpiece for retracting the latch, the cam block having a release cam thereon, said deadlocking lever having a blocker arm movable into the path of the latch to deadlock it against retraction means to bias such deadlocking lever toward deadlocking position, said lever also having a cam nose thereon in the path of retraction movement of the cam on said cam block for actuating the deadlocking lever to non-blocking position in response to initial retraction movement of the cam block, and a manually actuated retraction lever for driving the cam block to retract the latch. The lock preferably also includes a dead bolt mounted in the case for movement through the front between retracted and projected positions, a key-operated cylinder mounted in the case, and means operable by such cylinder for projecting and retracting the dead bolt, a cylinder latch lever for retracting the latch in response to key operation of the cylinder, inner and outer coaxial knob hubs mounted for independent rotation in the case and having roll-back cams thereon, and a hub lever mounted in the case and movable by such roll-back cams in a direction to retract the latch, and stop-work means to lock the outer knob hub against rotation. In such case, both the hub lever and the cylinder latch lever are arranged to drive said cam block in latch-retracting movement in response, respectively, to actuation of the latch lever by one of the knob hubs and to actuation of the cylinder latch lever by key operation of the cylinder, so that the same single release cam acts to release the deadlocking lever when the latch is retracted by either knob or cylinder operation. Further and particular features of the invention are exemplified in the embodiment shown in the accompanying drawings and described below.

The accompanying drawings illustrate the invention and show an embodiment exemplifying the best mode of carrying out the invention as presently perceived. In such drawings.

Figure 1:
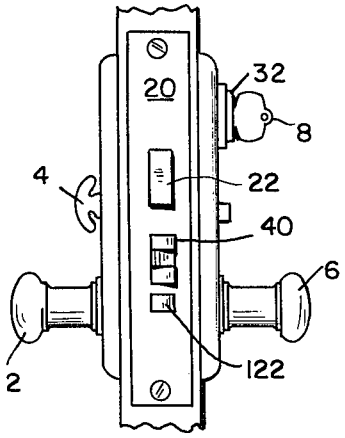
FIG. 1 is a diagrammatic edge elevation of a door fitted with a mortise lock having a hotel function.

The hotel-function mortise lock shown in FIG. 1 has its front 20 flush with the door edge and contains a dead bolt 22, a latch 40 biased to projected position, and an auxiliary latch 122. An inside knob 2 is operable under all conditions to retract the latch 40. An inside turnknob 4 is operable to project and retract the dead bolt 22. An outside knob 6 is fixed and serves only as a handle. An outside cylinder 32 is operable by a "room" key 8 to retract the latch 40 but not operable either to project or to retract the dead bolt, so that projection of the dead bolt from the inside locks out use of a room key to open the door. The cylinder 32 is, however, operable by an "emergency" key (not shown) either to retract the dead bolt so as to gain entrance, or to project the dead bolt so as to lock out entrance by use of a room key. Since the dead bolt will not be locked when the door is normally closed from the outside, it is necessary to deadlock the latch bolt.

The mortise lock shown in the drawings comprises a case 10 having top, bottom, and rear edge walls 11, 12, and 14, integral with a back side wall 15. A cover plate 16 covers the open side of the case, and a front 18 including a face plate 20 are attached to the open edge of the case. A dead bolt 22 is slidably mounted in the case for movement through the front between retracted position shown in FIG. 1 and projected position shown in FIG. 6, and such dead bolt has an offset tailpiece 24 containing an actuating slot 26 which receives an actuating arm 28 on a turnknob hub 30 rotatable in the case. An opening 32 is formed above such hub 30 for the reception of a cylinder 34 having a cam arm 36 for actuating the turnknob hub 30 to advance and retract the dead bolt 22.

A low-friction latch bolt or "latch" 40 is mounted for sliding movement through the front 18 between projected and retracted positions and has a tailpiece 42 extending rearward through a guide plate 44 mounted against a pair of pins 46 fixed in the back wall 15 of the case, the tailpiece extending therebeyond to a tailplate 48 fixed to its rear end. A biasing spring 50 about the tailpiece 42 reacts against the guide plate 44 and baises the latch bolt 40 to its projected position as shown in FIG. 1.

A cam block 52 is slidably mounted on the tailpiece 42 between the rear tail plate 48 and the fixed pins 46. The tailpiece is adapted to slide freely through the cam block, as when the latch 40 is thrust rearward by engagement with a strike, and the cam block is adapted to retract the latch 40 when it is driven rearward against the tailplate 48. A latch lever 54 for key retraction of the latch is pivotally mounted by a pivot 55 in the case and carries a tab 56 in the path of the cylinder cam arm 36 and has a lower end 58 in position to engage the cam block 52 to drive it rearward to retract the bolt 40. A pin 31 on the turnknob hub arm 28 normally holds the latch lever 54 in drive position as shown in FIG. 1.

Figure 3:
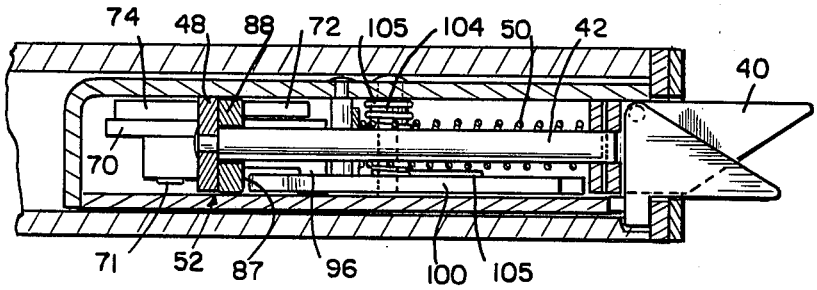
FIG. 3 is a section taken on the line 3—3 of FIG. 2, generally on the axis of the tailpiece of the latch.
Figure 4:
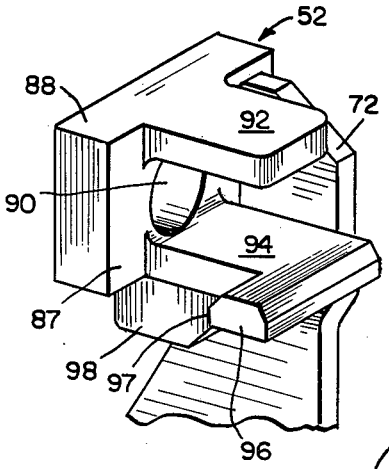
FIG. 4 is an isometric view showing the cam block which is slidably mounted on the latch tailpiece.

An outside knob hub 60 and an inside knob hub 62 are mounted coaxially in the case below the cam block 52. The inside knob hub is formed with a cross bar having roll-back cams 64 for engagement with tabs 66 and 68 on a lever mechanism for retracting the latch 40. As shown, such lever mechanism is a scissors mechanism including a hub lever 70 pivotally mounted on a pivot 71 and extending upward past the hub 62 to where the roll-back tab 66 is fixed to it, and thence upward to form a latch-retraction finger 72 bearing against the cam block 52 behind the tailpiece 42, as shown in FIGS. 1, 3 and 4. The scissors lever mechanism also includes a second or scissors lever 74 pivoted on a pivot 73 above the axis of the hubs 60 and 62 and extending counterclockwise about such hubs into integral supporting relation with the bottom roll-back tab 68. Such second or scissors lever carries a pin 76 engaged in a slot 78 in the lever 70, and the relationship is such that when the inside knob hub 62 is rotated clockwise, its lower roll-back cam 64 engages the roll-back tab 68 on the scissors lever 74 to thrust that lever rearward, and such rearward movement is transmitted by the pin 76 to the lever 70 to cause its latch-retracting finger 72 to retract the latch 40. Rotation of the inside knob hub 62 in either direction causes its roll-back cams 64 to engage one of the lever tabs 66 and 68 so as to move the levers rearward and cause the retraction finger 72 to retract the latch 40. The outer knob hub 60 may also have roll-back cams, but has an arcuate portion 61 therebetween and is fixed against rotation by a stop-work member 80 in the form of an angle bar with one leg 82 engaged in a slot in the arcuate portion 61 and with the other leg held in fixed position between a boss 84 and a pin 86 fixed to the side wall 15 of the case.

Figure 2:
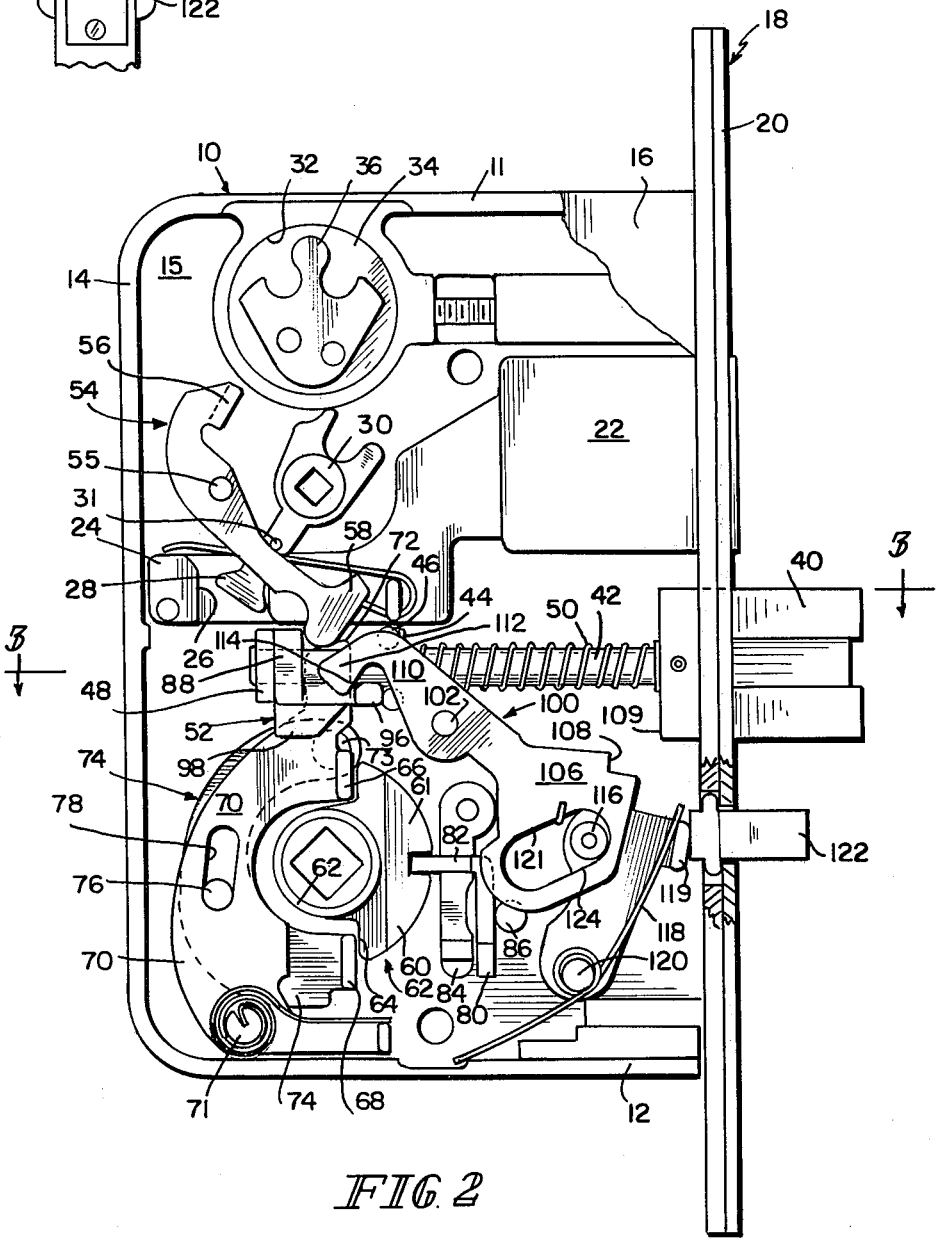
FIG. 2 is a side elevation of a mortise lock embodying the invention, with the side plate broken away.

As shown in FIGS. 2 and 4, the cam block 52 comprises a rear cross bar 88 with a central hole 90 therein to slidably receive the cylindrical tailpiece 42, an upper stabilizing finger 92 extending forward over the tailpiece from the upper edge of the cross bar 88, and a lower cam-supporting arm 94 extending forward from the bottom edge of the cross bar 88, below the hole 90, and supporting a cam finger 96 at its forward end which projects forward from the support arm 94 to define a clearance space between its rear side face 97 and the front side face 87 of the cross bar 88. The upper face of the cam finger 96 is formed with rounded or bevelled cam edges for cooperation with the cam nose of the deadlocking lever described below. The cam block 52 also has a stabilizing rib 98 extending downward from its bottom arm 94 and with its back face in slidable relation with the front face of the hub lever 70 just below its retraction finger 72, as shown in FIG. 4.

Figure 5:
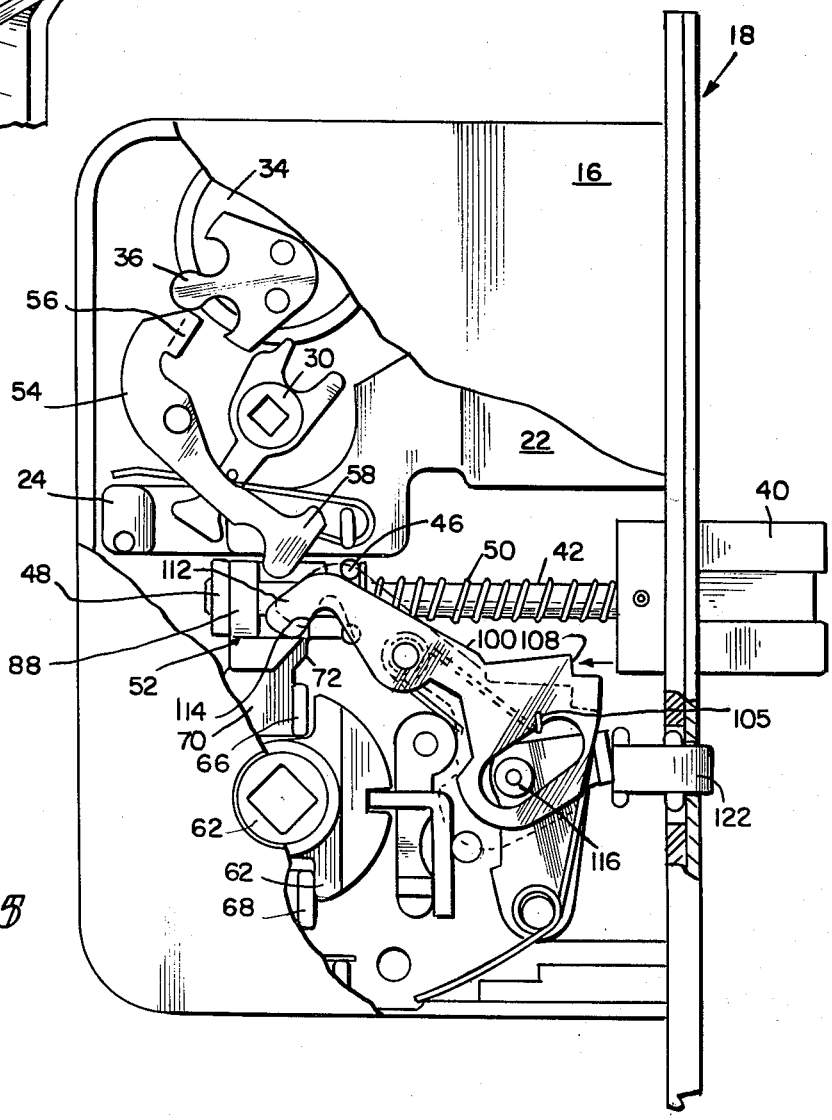
FIG. 5 is like FIG. 2, with the parts in door-closed positions and the key cylinder partially actuated.

A deadlocking lever 100 is mounted by a pivot pin 102 for pivotal movement in a plane in front of the tailpiece 42 as shown in FIG. 1. As shown in FIG. 3, the pivot stud 102 is pivotally received in a pivot sleeve 104 fixed to the side wall 15 of the case. The pivot pin lies behind the latch 40 and ahead of the cam block 52. The deadlocking lever 100 has a deadlocking arm 106 extending forward from the pivot and formed with a stop shoulder 108 adapted to be positioned behind the lower rear corner 109 of the latch 40. The deadlocking lever 100 also has a release arm extending rearward from the pivot and upward over the top of the cam finger 96 of the cam block 52, and its end is bent downward to form a cam nose 112 extending toward the clearance space between the faces 87 and 97 of the cam block 52, as shown in FIGS. 1 and 3. The cam nose 112 is formed with a bottom cam ramp 114 in position to be engaged by the cam finger 96 of the cam block 52. The deadlocking lever is biased by a torsion spring 105 (shown in FIG. 5) for rotation in a direction to move its shoulders 108 to deadlocking position behind the latch 40 as shown in FIG. 5. In the position of the parts as shown in FIG. 1, the cam lever is rotated clockwise against such bias to its release position, by a roller pin 116 on an auxiliary latch lever 118 pivoted on a pivot 120 fixed to the case. The roller pin 116 lies in an opening 121 formed in the deadlocking lever 100, the bottom edge of which forms a cam ramp 124 which is normally engaged by the roller pin 116. The upper end of the auxiliary latch lever carries a tab 119 which lies close behind and is biased against an auxiliary latch 122 mounted for pivotal retraction movement through the front 18 when the door is closed against a strike.

Operation of the mortise lock is as follows. In FIG. 1, the positions of the parts are the positions they normally take with the door containing the mortise lock standing open, so that the dead bolt 22 is retracted and the latch bolt 40 and the auxiliary latch 122 are projected. The deadlocking lever 100 is held in its release position by the roller pin 116, and the latch 40 is free to be thrust rearward through the front 18 when the door is closed against the strike. In such movement, the tailpiece 42 will be free to slide through the cam block 52, but such block will also be free to move rearward, but may be lightly held in place by slight engagement of the cam nose 112 behind the cam finger 96 of the cam block 52. As the strike thrusts the latch 40 rearward, it will also thrust the auxiliary latch 122 rearward to allow the deadlocking lever 100 to move toward deadlocking position, but the timing is such that the rear corner 109 of the latch will pass the blocking shoulder 108 of such lever before such shoulder moves into blocking position, and the lever will ride against the bottom of the latch 40. When the door reaches closed position, the latch 40 will come into alignment with the keeper opening in the strike, and will be moved by the biasing spring 50 to its projected position as shown in FIG. 5, while the auxiliary latch 122 will be held retracted by the strike. As the latch 40 thus moves forward through the strike, its lower rear corner 109 will pass the blocking shoulder 108 of the deadlocking lever 100, and the biasing spring of that lever will move it counterclockwise to the position shown in FIG. 5, in which such shoulder will lie behind the latch 40 and deadlock it against retraction. Such counterclockwise movement will carry the cam nose 112 downward against the cam finger 96 of the cam block 52, with the cam ramp 114 bearing against that finger.

Under these normal door-locked conditions, the latch 40 may be retracted to open the door, either by operation of the inner knob from inside the door, or by key operation of the cylinder 34 from outside. Inner knob operation will rotate the inner knob hub 62 to actuate the scissors lever mechanism and thus pivot the hub lever 70 rearward to carry its retraction finger 72 against the rear cross bar 88 of the cam block 52 to exert thrust on the tailplate 48 and thus retract the latch 40. During initial retraction movement of the cam block 52, the cam finger 96 will act on the cam nose 112 of the deadlocking lever 100 to lift its rearward release arm 110 and rotate the deadlocking lever clockwise to a release position as shown in dotted lines in FIG. 5 and full lines in FIG. 1. Further retraction of the latch 40 can then occur without interference from the deadlocking mechanism. Similarly, key operation of the cylinder 34 will carry its cam arm 36 in a counterclockwise direction against the tab 56 of the latch lever 54 to pivotally move that latch lever in a clockwise direction to carry its retraction head 58 against the cross bar 88 of the cam block 52, as shown in FIG. 5. Further rotation of the cylinder cam arm 36 will then drive the latch lever clockwise to drive the cam block 52 rearward and thus to retract the latch 40 and release the deadlocking lever in the same manner as in operation by the inside knob. Whether operation is by the knob hub lever 70 or the cylinder latch lever 54, the same single release cam 96 will move the deadlocking lever to release position.

Figure 6:
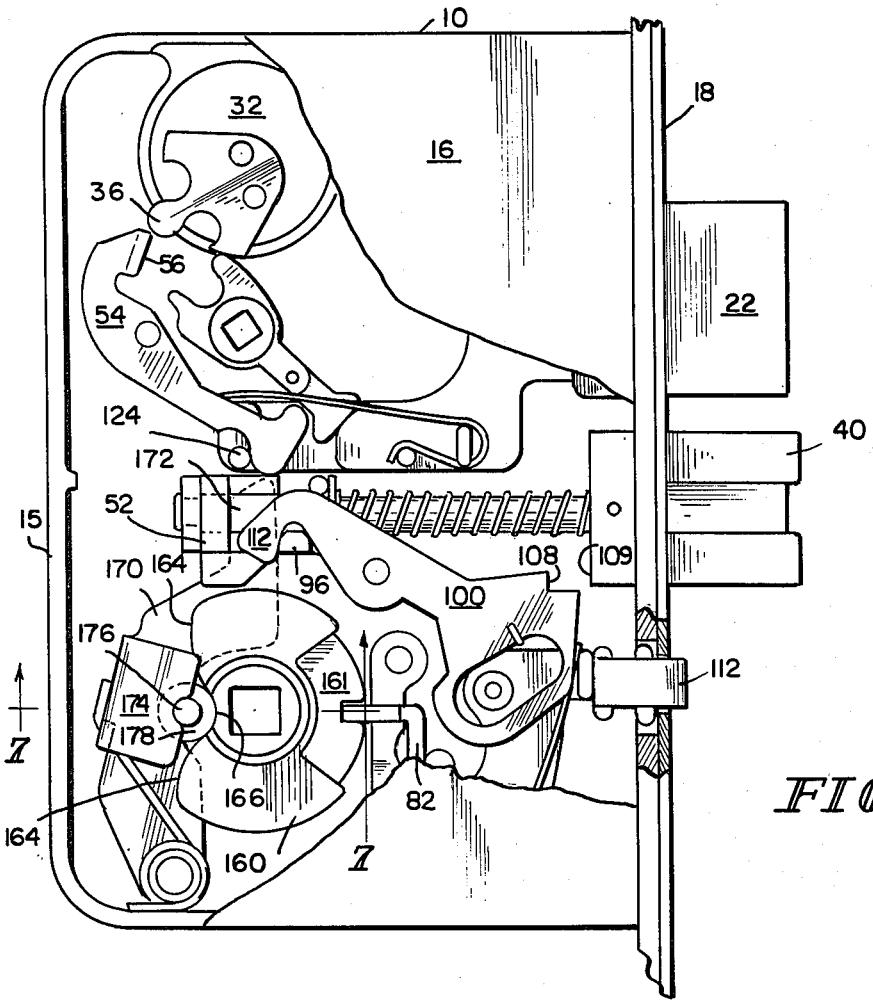
FIG. 6 is like FIG. 5, but with the dead bolt projected, and showing a different knob-actuated latch-retraction mechanism.

The dead bolt 22 can be projected to the position shown in FIG. 6 by operation of the turnknob 4 at the inside of the door to swing the turnknob hub 30 to the position shown in FIG. 6, and can be retracted from inside the door by reverse operation of the turnknob 4 to return the hub to its position shown in FIG. 2. In the hotel function, however, the dead bolt 22 cannot be either projected or retracted by key operation of the cylinder 32 because the cylinder used is one which normally blocks rotation of the cam arm 36 through the movement required for such retraction. Accordingly, when the dead bolt 22 is projected by means of the turnknob from inside the room, this will "lock out" entry of maids or other service personnel from outside the door. Since the door cannot normally be deadlocked by the dead bolt 22, it is necessary to deadlock the latch in a hotel function lock.

For emergency purposes, the cylinder used does permit bolt retraction by means of an emergency key which releases the cam arm 36 for rotation through the motion required to move the hub lever 30 through its bolt-retracting stroke. Also, while a room occupant cannot project the dead bolt by room-key operation of the cylinder, the hotel operator, by use of the emergency key to operate the cylinder cam arm 36, is able to throw the dead bolt 22 to its projected position from outside the door, and thus to block out any access to the room by use of a room key.

As shown in FIG. 6, to facilitate emergency key operation, movement of the dead bolt 22 to its projected position, either by the inside turnknob or by operation of the cylinder with an emergency key, has the effect of swinging the latch lever 54 to a position in which its tab 56 swings clear of the path of the cylinder cam arm 36. For this purpose, when the dead bolt 22 is projected, a post 124 at the rear of the dead bolt tailpiece moves against the back side of the operating arm of the latch lever 54 to swing it forward and thus tilt its tab 56 to a retracted position out of the path of movement of the cylinder cam arm 36, where it permits movement of such arm past the tab and into and away from operating engagement with the turnknob hub 30.

The lock shown provides all the operations and safeguards required for hotel function, and also provides an improved latch deadlocking and deadlocking release mechanism which is of simple and sturdy construction and which employs only the single release cam 96 to release the deadlock whether the lock is operated by the inside knob or by the outside key cylinder, and does so in a manner such as to simplify and improve construction and assembly of the lock and to provide a uniform and accurate timing relationship between the various operating parts.

Figure 7:
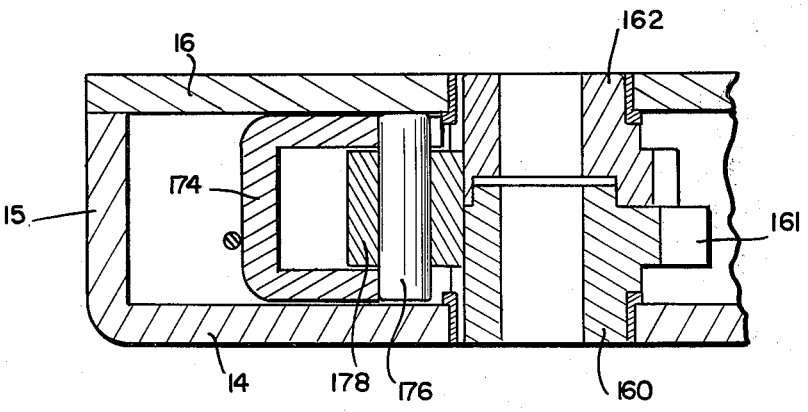
FIG. 7 is a section on the line 7—7 of FIG. 6.

The key-actuated latch-retraction mechanism shown in FIG. 6 has the same general latch-retracting function as the mechanism shown in previous Figures and comprising the scissors levers 70 and 74 and the roll-back knob hubs 60 and 62. The latch-retraction mechanism shown in FIGS. 6 and 7 comprises an outside knob hub 160 and an inside knob hub 162. The outside knob hub 160 has an arcuate flange 161 containing a slot engaged by the stop-work bar 82 to lock the outside knob against rotation as in the previous modification. Both knob hubs have opposite cam faces 164 extending rearward and outward in opposite directions from a cam valley 166. A hub lever 170 is pivoted on a pin 171 at the bottom of the case and extends upward about the rear side of the hubs and has a latch-retraction finger 172 engaged with the cam block 52 in the same way as the finger 72 of the latch lever 70. Behind the hubs, the lever 170 is bent to form a yoke 174 formed with trunnion bearings for the pivot pin 176 of a roller cam follower 178 which normally lies engaged in the cam valley 166 of the hubs 160 and 162. When the inside hub 160 is rotated in either direction, one of its cam faces 164 rides against the roller 178 to thrust such roller rearward and thus to pivot the latch-retraction lever 170 counterclockwise to cause its retraction finger 172 to drive the cam block 52 rearward and thus retract the latch 40. The arrangement provides that substantially the same torque exerted on the knob and its hub 160 will be required to retract the latch in either direction of knob rotation. Such roller lever latch-retraction mechanism is believed to be novel with applicant and advantageous over prior mechanisms for analogous purposes.

I claim:

1. A mortise lock, comprising a case including a front, a dead bolt mounted in the case for movement through the front between retracted and projected positions, a key-operated cylinder mounted in the case and means operable thereby for projecting and retracting the dead bolt, a latch mounted in the case for movement through the front between retracted and projected positions and biased to projected position, a tailpiece connected to the latch and having a rearward-spaced tailplate by which the latch is retracted, a cylinder latch lever for retracting the latch in response to key operation of the cylinder, a deadlocking lever for deadlocking the latch and means for positioning the deadlocking lever in deadlocking position when the lock is in door-closed relation with a strike, an inner knob hub mounted for rotation in the case and having a roll-back cam thereon, and a hub lever mounted in the case and movable by such cam in a direction to retract the latch, wherein the improvement comprises a cam block mounted in the case for movement aginst said tailplate for retracting the latch, and having a release cam thereon, said deadlocking lever having a blocker arm movable into the path of the latch to deadlock it against retraction, means to bias said deadlocking lever toward deadlocking position, said deadlocking lever also having a release arm with a cam ramp thereon in the path of retraction movement of the cam on said cam block for actuating the deadlocking lever to non-blocking position in response to initial retraction movement of the cam block, said knob hub lever and cylinder latch lever both being arranged to drive said cam block in latch-retracting movement in response, respectively, to knob actuation of the hub lever and to cylinder actuation of the cylinder latch lever.

2. A mortise lock as in claim 1, further comprising an outside knob hub mounted in the case coaxially with the inner knob hub, and stop-work means to lock such outer knob hub against rotation.

3. A mortise lock as in claim 2 in which said stop-work means is a stop bar fixedly mounted in the case and engaged in an opening in the outer knob hub.

4. A mortise lock as in claim 1 in which said cam block is slidably mounted on the tailpiece and includes a rear cross bar projecting beyond both sides of said tailpiece, a forward-projecting arm extending longitudinally of the tailpiece, and a front cross bar projecting beyond one side of the tailpiece and forming the said release cam on the cam block, the cam ramp on said deadlocking lever being moved into position for operation by the release cam when the deadlocking lever is moved to deadlocking position.

5. A mortise lock as in claim 4 with the addition that said cylinder latch lever extends downward into engagement with the cam block cross head in a plane on the same side of the tailpiece as the cam nose of the deadlocking lever and the hub lever extends upward into engagement with said cross head on the opposite side of the tailpiece.

6. A mortise lock as in claim 5 in which said forward projecting arm of the cam block lies below the tailpiece and the tailpiece includes a stabilizing arm above the tailpiece and between the cylinder latch lever and the hub lever.

7. A mortise lock as in claim 4 with the addition of a stabilizing rib extending downward from the cam block in stabilized relation with said hub lever.

8. A mortise lock as in any of claims 1, 4, 5, and 7 in which said deadlocking lever is pivoted on a support fixed on the case and located below and longitudinally of the tailpiece between the cam block and the latch, the blocker arm of the lever extending forward of the pivot and having a blocking shoulder movable upward into deadlocking position behind the latch, the release arm thereof extending rearward of the pivot and over the top of the cam on the cam block so as to be lifted by such cam and thereby lower the blocking shoulder out of blocking relation with the latch.

9. A mortise lock, comprising a case including a front, a latch mounted in the case for movement through the front between retracted and projected positions and biased to projected position, a tailpiece connected to the latch and having a rearward-spaced tailplate for retracting the latch, a deadlocking lever for deadlocking the latch and means for positioning the deadlocking lever in deadlocking position when the lock is in door-closed relation with a strike, wherein the improvement comprises a cam block slidably mounted for movement against said tailplate for retracting the latch and having a release cam thereon, said deadlocking lever having a blocker arm movable into the path of the latch to deadlock it against retraction, means to bias said lever toward deadlocking position, said lever also having a cam ramp thereon in the path of retraction movement of the release cam on said cam block for actuating the deadlocking lever to non-blocking position in response to initial retraction movement of the cam block, and a manually actuated latch retraction lever or the like for driving said cam block to retract the latch.

10. A mortise lock as in claim 9 in which said cam block is slidably mounted on the tailpiece and includes a rear cross bar projecting beyond both sides of said tailpiece, a forward-projecting arm extending longitudinally of the tailpiece, and a front cross bar projecting beyond one side of the tailpiece and forming the said cam on the cam block, the cam ramp on said deadlocking lever being moved into position for operation by the release cam when the deadlocking lever is moved to deadlocking position.

11. A mortise lock as in claim 10 which includes a key-operated cylinder above the latch and a cylinder latch lever extending downward into position to engage the cam block cross head in a plane on the same side of the tailpiece as the cam nose of the deadlocking lever, and includes a knob hub below the latch and a hub-actuated retraction arm extending upward into engagement with said cross head on the opposite side of the tailpiece.

12. A mortise lock as in claim 11 in which said forward projecting arm of the cam block lies below the tailpiece and the tailpiece includes an upper arm above the tailpiece and between the cylinder latch lever and the hub lever.

13. A mortise lock as in claim 10 with the addition of a stabilizing rib extending downward from the cam block in stabilized relation with said hub lever.

14. A mortise lock as in claim 9 which includes separate first and second manually actuated latch retraction levers, both engageable with said cam block for separately driving the same for retracting the latch and thereby actuating the same deadlocking release cam carried by said cam block.

15. A mortise lock as in any of claims 9, 10, 11, 13, and 14 in which said deadlocking lever is pivoted on a support fixed at the case and located below and longitudinally of the tailpiece between the cam block and the latch, the blocker arm of the lever extending forward of the pivot and having a blocking shoulder movable upward into deadlocking position behind the latch, the release arm thereof extending rearward of the pivot and over the top of the cam on the cam block so as to be lifted by such cam and thereby lower the blocking shoulder out of blocking relation with the latch.

* * * * *